United States Patent [19]

Kershner et al.

[11] 3,991,500

[45] Nov. 16, 1976

[54] FIREARM SIGHT WITH DIALABLE RANGE CONTROL

[75] Inventors: Stuart D. Kershner, Bethany, Conn.; David F. Butler, Pompano Beach, Fla.

[73] Assignee: The United States of America as represented by the Secretary of the Army, Washington, D.C.

[22] Filed: Aug. 22, 1975

[21] Appl. No.: 606,824

[52] U.S. Cl. ..... 42/1 S; 33/241; 356/252

[51] Int. Cl.[2] ..... F41G 3/06

[58] Field of Search ..... 42/1 S, 1 ST; 33/241; 350/10; 356/251, 252

[56] References Cited

UNITED STATES PATENTS

| | | | |
|---|---|---|---|
| 3,645,635 | 2/1972 | Steck | 356/252 |
| 3,711,204 | 1/1973 | Steck | 350/10 |
| 3,782,822 | 1/1974 | Spence | 42/1 S |
| 3,813,790 | 6/1974 | Kaltmann | 42/1 S |

*Primary Examiner*—Charles T. Jordan
*Attorney, Agent, or Firm*—Nathan Edelberg; A. Victor Erkkila; Thomas R. Webb

[57] ABSTRACT

A shoulder firearm is provided with a receiver-mounted collimating optical sight comprising a housing containing a hollow pivoted, reticle holder, an elongated rod of fluorescent material mounted in the forward end of the holder, an inclined first mirror which reflects light from a reticle at the rear end of the rod transversely to a half-reflecting second mirror, parallel to the first mirror, which, in turn, reflects the light back to the shooter's eye. A vertical range scale is mounted on the second mirror adjacent to the reticle image. To aim the firearm, the shooter aligns the reticle image with a distant target. The reticle is adjusted vertically for different ranges by means of a range knob mounted on the firearm near the trigger and connected by pinion and rack gears to the reticle holder, by rotating the range knob while observing the relative positions of the reticle image and range scale. The reticle includes a horizontal fiducial marker. The positions of the range scale and fiducial marker may be interchanged. The projectile may be an explosive one carrying a delay firing circuit for exploding the projectile in air over the target at a pre-selected range, in which case the range knob also operates a potentiometer to adjust a voltage supplied to a projectile firing circuit to the same range as applied to the sight.

5 Claims, 6 Drawing Figures

FIREARM SIGHT WITH DIALABLE RANGE CONTROL

GOVERNMENTAL INTEREST

The invention described herein may be manufactured, used and licensed by or for the Government for Governmental Purposes without the payment to us of any royalties thereon.

BACKGROUND AND SUMMARY OF THE INVENTION

The present invention relates to an improved firearm sight, and particularly to the combination of a shoulder-fired gun and an improved optical sight that is easily adjustable by the shooter for corrected ranges after observing previous target misses due to incorrect range settings, without removing the eye from the target or sight.

The invention is particularly useful in the "area fire" mode in which an explosive shell is projected to the immediate area of the target, such as a prone man, and exploded in air over the target by a time fuze carried by the shell.

Range-adjustable sights are, of course, well known in the art. Most of these involve the combination of a fixed front sight with a vertically-adjustable rear sight, as in Everitt U.S. Pat. No. 2,871,566, for example.

Steck U.S. Pat. No. 3,645,635 discloses a collimating sight comprising a rod of fluorescent material mounted in a tubular holder for pivotal movement about the rear end of the holder in a housing. Light from the target passes through the rod, which provides a reticle and is reflected by a first mirror onto a half-reflecting second mirror, where the reticle image is viewed superposed on the target image. The range is adjusted by pivoting the rod vertically, by means of an adjusting screw, which changes the angle between the rod axis and the gun bore on which the sight is mounted.

In accordance with one aspect of the present invention, a collimating sight of the type disclosed in Steck U.S. Pat. No. 3,645,635 is improved by substituting, for the adjusting screw of Steck, a range knob mounted on the firearm near the trigger and operatively connected to the rod holder, as by a rack and pinion gear combination, and mounting a range scale on either the second mirror or the reticle holder and a fiducial marker on the other, whereby the firearm can be used against a visible target by: (1) estimating the range to the target; (2) setting the range knob to this range while observing the relative positions of the marker image on the scale, or the scale image on the marker; (3) aiming and firing the firearm at the target; (4) visually observing the location of the shot relative to the target; (5) resetting the range knob to a corrected range; and re-aiming and re-firing at the target.

In a preferred embodiment, incorporating explosive shells to be exploded in air over the target, the invention further involves coupling to the range knob a variable resistance, e.g. a potentiometer, connected to a firing delay circuit in the explosive shell, whereby adjustment of the range knob to a particular range on the range scale also adjusts the time of the delay circuit to the same range.

DETAILED DESCRIPTION OF PREFERRED EMBODIMENTS

Figure 1:
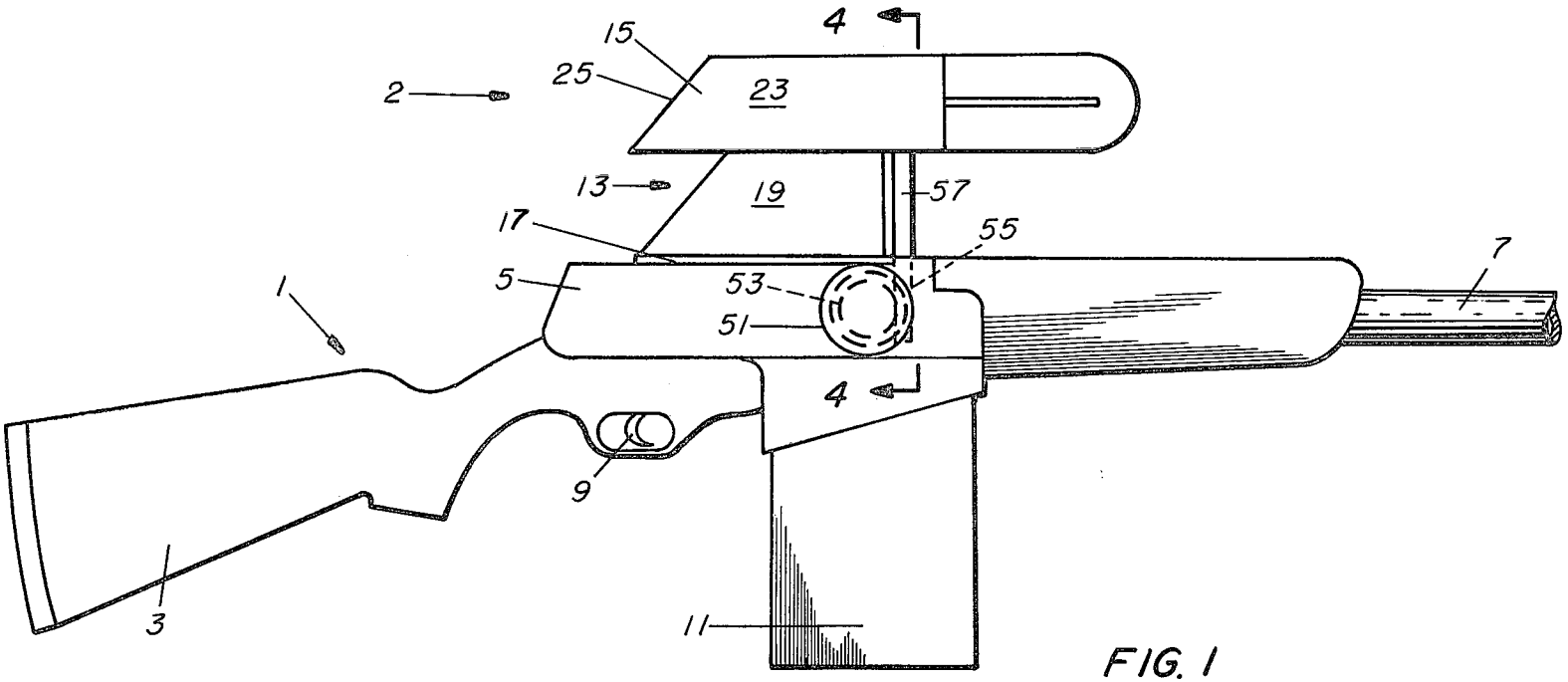
FIG. 1 is a side view of a shoulder firearm and sight incorporating one embodiment of the present invention.

The drawing illustrates, for example, a shoulder firearm having an optical sight somewhat similar to that of Steck U.S. Pat. No. 3,645,635. The firearm 1 comprises a shoulder stock 3, a receiver 5, a barrel 7, a trigger 9, a cartridge magazine 11, and a collimating optical sight 13. The sight 13 comprises a housing 15 including a base 17 attached to the top of the receiver 5 and two vertical walls 19 of trapezoidal shape integral with base 17 and connected at the top by a transverse wall 21. Wall 21 is joined or integral with a curved wall 23 having a rear end 25, which is inclined parallel to the rear end of trapezoidal walls 19 and closed by a plate 27.

Disposed within the curved wall 23 is a hollow reticle holder 29 having an enlarged rear end portion 31 which loosely engages the walls 21 and 23 to act as a pivot. A rod 33 of fluorescent material is carried by a ring 35 mounted in the forward end of the holder 29. The holder 29 is tapered slightly to permit substantial vertical pivoting of the holder and rod. The rod is enclosed in a transparent cover 37. Light from the rear end 39 of the rod 33, which acts as a reticle, is projected to a reflective first mirror 41 and reflected thereby to a semitransparent second mirror 43 mounted on the inclined edges of trapezoidal walls 19. Preferably, the reticle 39 comprises a central horizontal fiducial marker, such as a central horizontal line. A calibrated vertical range scale 45 is mounted on the rear face of mirror 43 adjacent to the image 46 of the reticle 39, as seen by the eye at 47. The distant target is viewed by the eye in alignment with the reticle image and range scale. Preferably, a lens 49 is mounted in the holder 29 to collimate the reticle light to parallel rays.

Figure 3:
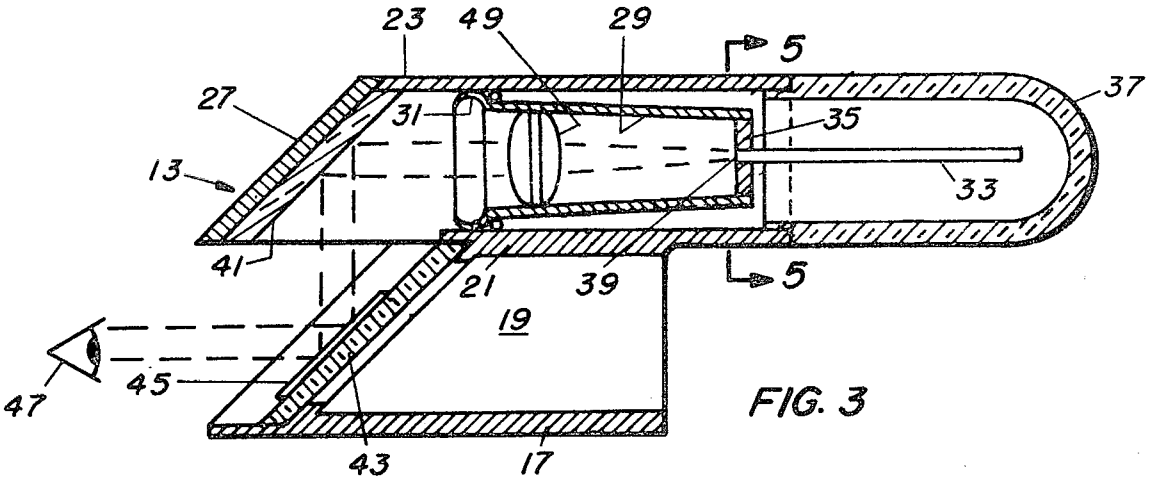
FIG. 3 is a vertical longitudinal section view of the sight taken on line 3—3 of FIG. 2.

FIG. 3 shows substantially a zero range arrangement wherein the line of sight to the target is substantially parallel to the gun axis. In order to adjust the sight to different ranges, a range knob 51, rotatably mounted on the side of the receiver 5, near the trigger 9, has a pinion gear 53 meshed with the teeth of a vertical rack gear 55 on the lower end of an operating bar 57. The upper end of bar 57 extends through wall 21 and is connected to the forward end of holder 29, as by a bolt 59. Thus, the vertical position of the reticle 39 can be easily adjusted by rotation of the range knob 51 by the trigger hand of the shooter.

In the operation of the firearm and sight, the shooter estimates the range to the visible target, sets the range by adjusting the range knob 51 while observing the reticle image 46 on the scale 45, aims the loaded firearm at the target by aligning the reticle and marker image with the target, and fires a shot, without removing his eye from the target. When the shot is fired, the shooter continues observing the target, locates the shot with respect to the target, estimates a corrected range, re-sets the range knob to the corrected range, re-loads, re-aims and re-fires the firearm at the target, still without removing his eye from the sight and the target. This operation can be repeated until a hit is obtained.

Figure 5:
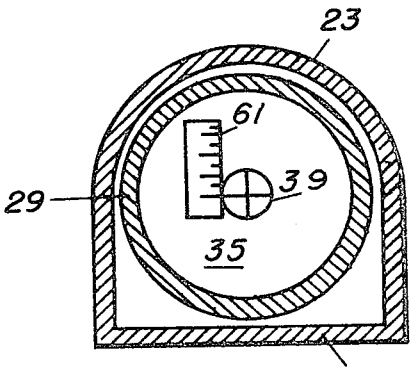
FIG. 5 is an enlarged transverse section view, taken on line 5—5 of FIG. 3 showing a modification.
Figure 2:
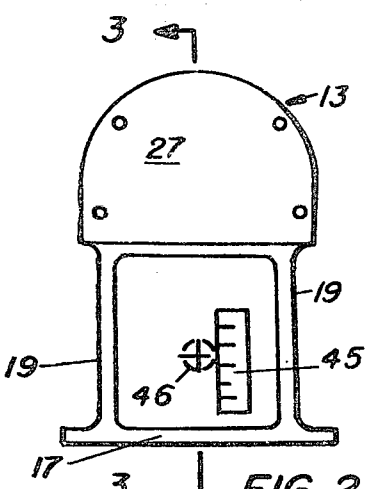
FIG. 2 is a rear view of the sight of FIG. 1, in the direction of the Arrow 2.
Figure 4:
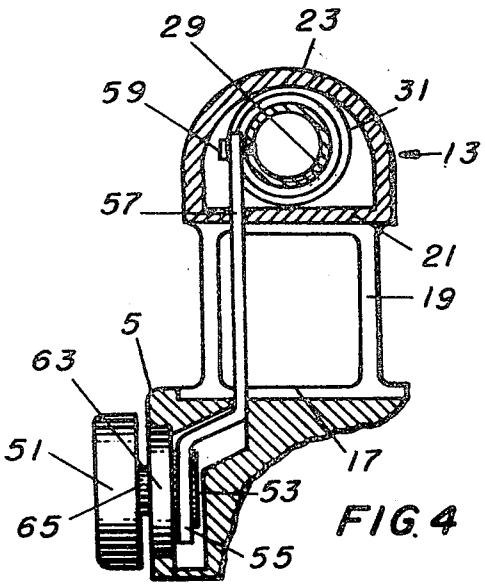
FIG. 4 is a transverse vertical section taken on line 4—4 of FIG. 1.

FIG. 5 shows a modification wherein a range scale 61 is mounted on the ring 35 adjacent to the reticle 39 to cooperate with a horizontal fiducial marker (not shown) mounted on the mirror 43, in place of the range scale 45 of FIGS. 1–4. In this case, an image of the scale 61 appears on the mirror 43 adjacent to the reticle image 46.

Figure 6:
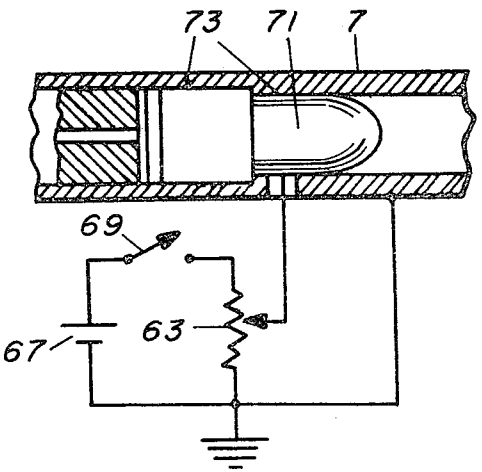
FIG. 6 is a vertical longitudinal section view of the chamber portion of the firearm, with associated circuit elements.

Preferably, the range knob 51 is combined with a variable resistance, in the form of a potentiometer 63, mounted in the receiver 5 around the knob shaft 65 and operable thereby. This potentiometer is connected in parallel with a battery 67, through a switch 69, to supply a variable voltage to a delay firing circuit (not shown), carried by an explosive projectile 71 while the latter is in the cartridge chamber 73 of the gun barrel 7, as schematically shown in FIG. 6 to adjust the delay time of the firing circuit for explosion of the projectile over the target at a given range. The delay firing circuit in the projectile may, for example, be that disclosed and claimed in a copending application of Charles G. Irish, Jr., Ser. No. 543,287, filed 22 Jan. 1975, assigned to the same assignee.

In operation, when the shooter rotates the range knob 51 to adjust the sight line for a given range, the range knob also rotates the movable contact of the potentiometer 63, which adjusts the voltage applied to the projectile firing circuit to a delay time corresponding to the same range. The switch 69 may be operated by a partial initial pull on the gun trigger 9, as described in said copending application.

What is claimed is:

1. A firearm comprising:

a receiver and a barrel having a bore and a chamber for receiving a cartridge;

means for firing said cartridge;

an optical collimating sight mounted on said firearm including a window for viewing the real image of a distant target, a reticle mounted for vertical movement in said sight, a horizontal fiducial marker and a vertically-extending range-indicating scale, one of said marker and said scale being mounted for concurrent vertical movement with said reticle and the other being fixed on said window, and means for projecting an image of said reticle and said one of said marker and said scale onto said window and superposed on said target image and said other of said marker and said scale;

a range knob mounted on said firearm; and means connecting said range knob to said reticle for moving said reticle and said one of said marker and said scale vertically relative to said barrel to adjust the angle between the barrel bore and the sight line passing centrally through said image for a selected target range;

whereby said firearm can be utilized against a visible target by: estimating the range to the target; setting the range knob to the estimated range while observing the position of one of the marker image on said scale and the scale image on said marker, thereby adjusting the sight line for the estimated range; aiming and firing the firearm at the target; visually observing the location of the shot with respect to the target; resetting the range knob to a corrected range; and re-aiming and re-firing the firearm at the target without removing the eye from the target and sight.

2. A firearm as in claim 1, wherein said scale is carried by said window and said fiducial marker is carried by said reticle.

3. A firearm as in claim 1, wherein said firing means includes a trigger, and said range knob is conveniently located near said trigger.

4. A firearm as in claim 1, wherein:

said cartridge includes an explosive projectile having delay fuze means for exploding the projectile in air at a selected range from the firearm; and said firearm further comprises means actuated by said range knob for adjusting the delay time of said delay fuze means for the selected range during sighting prior to firing.

5. A firearm as in claim 4, wherein:

said delay fuze means includes an adjustable electrical circuit; and said adjusting means comprises a variable resistor actuated by said range knob for adjusting said circuit.

* * * * *